US008268034B2

(12) United States Patent
Choi et al.

(10) Patent No.: US 8,268,034 B2
(45) Date of Patent: Sep. 18, 2012

(54) MANUFACTURING METHOD OF FERROMOLYBDENUM FROM MOLYBDENITE

(75) Inventors: Young Yoon Choi, Daejeon (KR); Sang Bae Kim, Daejeon (KR); Chang Youl Suh, Daejeon (KR); Chul Woo Nam, Daejeon (KR)

(73) Assignee: Korea Institute of Geoscience and Mineral Resources (KIGAM), Daejeon (KR)

( * ) Notice: Subject to any disclaimer, the term of this patent is extended or adjusted under 35 U.S.C. 154(b) by 152 days.

(21) Appl. No.: 12/995,870

(22) PCT Filed: Oct. 20, 2010

(86) PCT No.: PCT/KR2010/007193

§ 371 (c)(1),
(2), (4) Date: Dec. 2, 2010

(87) PCT Pub. No.: WO2012/026649

PCT Pub. Date: Mar. 1, 2012

(65) Prior Publication Data

US 2012/0174709 A1 Jul. 12, 2012

(30) Foreign Application Priority Data

Aug. 26, 2010 (KR) ..... 10-2010-0082876

(51) Int. Cl.
*C22C 38/12* (2006.01)

(52) U.S. Cl. ..... 75/10.15; 420/590

(58) Field of Classification Search ..... 75/10.15; 420/590

See application file for complete search history.

(56) References Cited

U.S. PATENT DOCUMENTS

| | | | | |
|---|---|---|---|---|
| 2,135,630 | A * | 11/1938 | Sullivan et al. | 75/10.6 |
| 4,039,325 | A * | 8/1977 | Buker | 420/429 |
| 2005/0279186 | A1 | 12/2005 | Leigh et al. | |

FOREIGN PATENT DOCUMENTS

| | | | |
|---|---|---|---|
| JP | 2006-2253 | A | 1/2006 |
| JP | 2009263723 | A | 11/2009 |
| JP | 2010-138420 | A | 6/2010 |
| JP | 2010132501 | A | 6/2010 |
| KR | 10-0637656 | B1 | 10/2006 |
| KR | 10-0646573 | B1 | 11/2006 |
| KR | 10-2009-0067993 | A | 6/2009 |

OTHER PUBLICATIONS

Derwent Acc No. 1972-23529T for SU 303359 A, application date Sep. 17, 1968. Abstract.*

* cited by examiner

*Primary Examiner* — George Wyszomierski
*Assistant Examiner* — Tima M McGuthry Banks
(74) *Attorney, Agent, or Firm* — The Webb Law Firm

(57) ABSTRACT

Provided is a manufacturing method of ferromolybdenum from molybdenite concentrate, and more particularly, a manufacturing method of ferromolybdenum with copper content of 0.5% or less from molybdenite with high copper content without carrying out a separate copper removing process by putting molybdenite, aluminum metal and iron metal, in a heating furnace and reacting them at high temperature to manufacture the ferro molybdenum at the lower portion thereof, forming a slag using aluminum sulfide and iron sulfide as the main components at the upper portion thereof, and putting most of the copper (80 to 95%) existing in the molybdenite in a slag layer. The exemplary embodiment can shorten a process as compared to a metallothermic reduction (Thermit) method of the related art and reduce the consumption of a reducing agent, i.e., aluminum.

5 Claims, 2 Drawing Sheets

【FIG. 1】
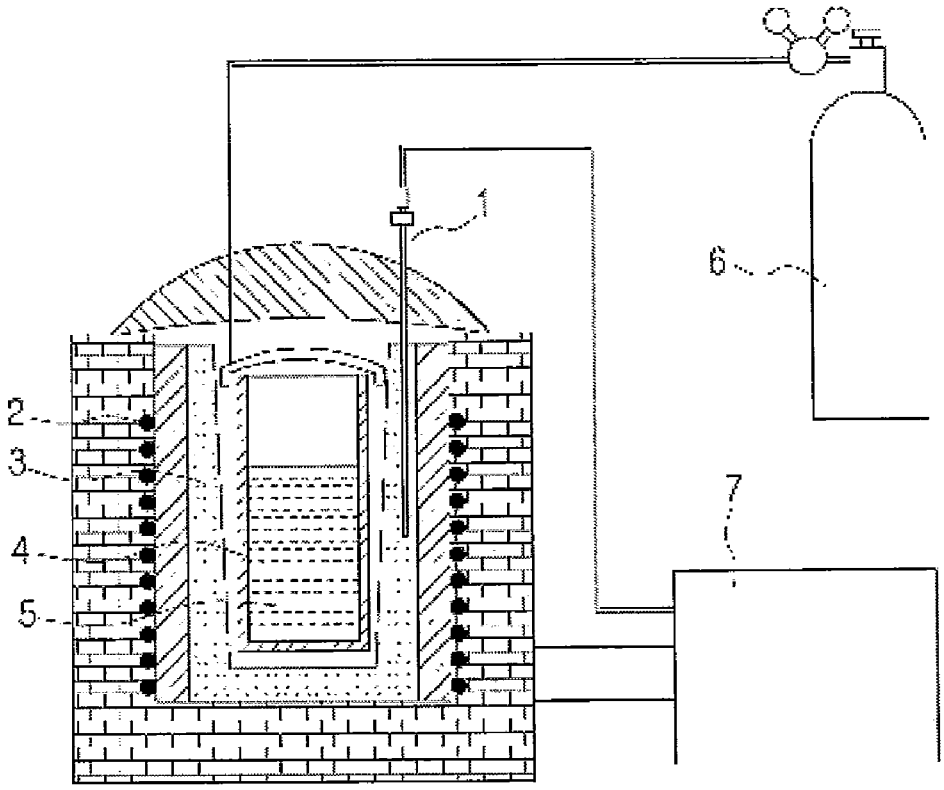

【FIG. 2】
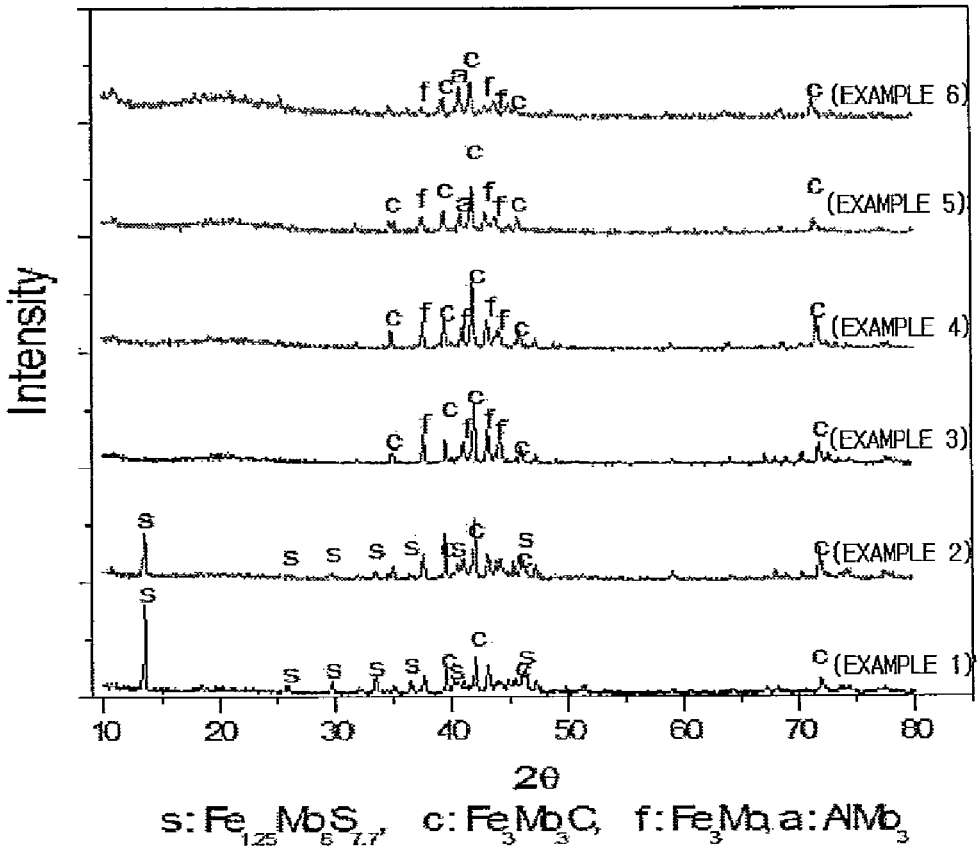

MANUFACTURING METHOD OF FERROMOLYBDENUM FROM MOLYBDENITE

This application is a national stage of PCT/KR2010/007193, filed Oct. 20, 2010.

CROSS-REFERENCE TO RELATED APPLICATIONS

This application claims priority under 35 U.S.C. §119 to Korean Patent Application No. 10-2010-0082876, filed on Aug. 26, 2010, in the Korean Intellectual Property Office, the disclosure of which is incorporated herein by reference in its entirety.

TECHNICAL FIELD

The present invention relates to a manufacturing method of ferromolybdenum with 0.5% or less copper content from a low-grade molybdenite (0.5 to 10 wt % Cu) with high copper content.

BACKGROUND

Molybdenum is a relatively rare element that is not found in metallic form in nature. The molybdenum serves to improve hot creep properties of steel, prevent temper brittleness of steel, and increase corrosion resistance of steel, which is a very important element to manufacture heat resistant steel or to manufacture corrosion resistant steel as an alloy element.

Molybdenite ($MoS_2$) is a primary raw material economically obtained. Generally, a relatively low concentration of about 0.05 to 0.1 wt % molybdenite ($MoS_2$) is included in raw ore; however, the molybdenite is easily recovered and concentrated by froth flotation due to properties of sulfides. The natural resource of usable molybdenite is mainly distributed in countries such as China, USA, Chile, or the like, which is mainly produced from a by-product of a copper mine.

Generally, the copper content of ferromolybdenum for making steel is limited to 0.5% or less. In order to lower the copper content of the molybdenite, degradation in recovery rate of molybdenum is inevitable because copper ore is also sulfide form. Meanwhile, molybdenite concentrate with high copper content is also produced and sold in some mines. Therefore, in order to use the molybdenite with high copper content, the copper content is lowered by using an acid leaching process after oxidation or by being mixed with ores with low copper content.

The ferromolybdenum implies an alloy of 50 to 75 wt % molybdenum and remaining iron, which is mainly used to add molybdenum during a steelmaking process. Generally, the ferromolybdenum is manufactured by a metallothermic reduction (Thermit) method that mixes molybdenum oxide ($MoO_3$) and iron oxide with a strong reducing agent, i.e., aluminum, and then reacts them. The metallothermic reduction method instantly generates a large amount of heat while oxidizing the aluminum by depriving oxygen from the molybdenum oxide or the iron oxide, such that the reaction temperature reaches a high temperature of 3000° C. or higher. In this case, when copper is included in a raw material, the copper is also reduced and thus, most of the copper exists in the metal, i.e, the ferromolybdenum alloy layer rather than in the oxide slag. Therefore, the copper content of the molybdenum oxide that is a raw material is strictly restricted.

Most of the molybdenum oxide is manufactured by roasting the molybdenite in the air at 560 to 600° C. When the copper content of the molybdenite is high, the copper is removed by acid-leaching oxidized ores after roasting and filtering it. During this process, since a considerable amount of molybdenum is eluted and thus, exists in the extracting solution, it is recovered by solvent extraction or pH control. During the roasting, a large amount of heat is generated by the combustion of molybdenum and sulfur. That is, the oxidation state of the molybdenum in the molybdenite is +4 and the oxidation state thereof in the oxidized ores is +6. Therefore, a larger amount of reducing agent than the molybdenite is needed in order to manufacture the ferromolybdenum from the oxidized ores. In addition, the metallothermic reduction process occurs explosively and completes almost immediately, such that it is difficult to control the reaction and it is impossible to obtain homogeneous products.

SUMMARY

An object of the present invention is to provide a manufacturing method of ferromolybdenum capable of reducing an amount of reducing agent by carrying out a direct reduction without carrying out an oxidation process when compared with a metallothermic reduction method of the related art, and in particular, directly using molybdenite with high copper content as a raw material.

The present invention relates to a manufacturing method of ferromolybdenum from molybednite. The manufacturing method directly manufactures the ferromolybdenium without roasting the molybdenite. In this case, in a method of removing the sulfur and impurities such as copper, and a reducing agent, i.e., aluminum metal is added to the molybdenite and reacted at high temperature in a heater.

More specifically, the manufacturing method of the ferromolybdenum according to the present invention includes: a) adding iron and aluminum metal in molybdenite with 0.5 to 10% copper content and mixing them; b) reacting the mixture in a heater at a temperature of 1100 to 2000° C. under an argon gas atmosphere; and c) naturally cooling the mixture at ambient temperature and obtaining reaction products.

At step A, a weight ratio of the mixture obtained by adding the iron and aluminum metal to the molybdenite may have 60 to 70 wt % molybdenite, 15 to 20 wt % iron, and 10 to 20 wt % aluminum metal. If the weight ratio of the mixture exceeds the above-mentioned values, the removal of sulfur and impurities may not be performed smoothly and the copper distribution in a slag layer of aluminum sulfide may be lowered.

Step B may be carried out for 10 to 30 minutes and the temperature of a heater including a direct or indirect heating furnace may be 1400 to 2000° C. If the heater exceeds the above-mentioned temperature, it is difficult to obtain targeted reaction products.

The heater uses an induction heating method, more preferably, an direct heating method due to an induction coil on the outside of a crucible using a high frequency generator, but is not limited thereto.

In this case, the atmosphere in the heater may be an argon gas atmosphere. The argon gas flux at the outside of the heater may be controlled according to the air-tightness degree of the apparatus required and may be sufficiently supplied in order to block the introduction of external air.

The ferromolybdenum having copper content less than 0.5% may be manufactured at the lower portion of the heater by the reaction and the slag layer including aluminum sulfide ($Al_2S_3$) as a main component and a small amount of iron sulfide (FeS) is formed at the upper portion thereof.

The reaction formula may be represented by the following Formula 1.

$$3MoS_2+4Al+xFe \rightarrow 2Al_2S_3+Fe_xMo_3 \quad (1)$$

In the reaction, the affinity of the copper and the sulfur is large such that the sulfides exist in most of the slag layer and the distribution ratio depends on the redox potential, i.e., the addition of aluminum.

The following Table 1 represents heat of reaction, deviation of Gibb's free energy, and reaction equilibrium constant when the molybdenite and the aluminum metal react at 1100 to 2000° C. As can be appreciated from the equilibrium constant values of Table 1, it can be expected that the concentration of molybdenum in the slag generated is very low in the equilibrium state. However, the heat of reaction is not large, such that the adiabatic reaction temperature is about 1000° C. As a result, heat should be applied from the outside in order to melt the ferromolybdenum and to carry out the phase separation.

TABLE 1

Reduction Reaction Thermodynamics Data

| Reaction Formula | Temperature (° C.) | ΔH (Kcal) | ΔG (Kcal) | Equilibrium Constant |
|---|---|---|---|---|
| $3MoS_2 + 4Al \rightarrow$ | 1100 | −88.185 | −114.393 | 1.615E+018 |
| $2Al_2S_3 + 3Mo$ | 1400 | −85.499 | −120.393 | 5.336E+015 |
| | 1700 | −82.745 | −126.880 | 1.134E+014 |
| | 2000 | −79.724 | −133.805 | 7.338E+012 |

BRIEF DESCRIPTION OF THE DRAWINGS

FIG. 1 is a schematic diagram of a reduction reaction apparatus according to the present invention; and FIG. 2 shows an XRD pattern of ferromolybdenum according to an exemplary embodiment of the present invention.

DETAILED DESCRIPTION OF EMBODIMENTS

The advantages, features and aspects of the present invention will become apparent from the following description of the embodiments with reference to the accompanying drawings, which is set forth hereinafter. The present invention may, however, be embodied in different forms and should not be construed as limited to the embodiments set forth herein. Rather, these embodiments are provided so that this disclosure will be thorough and complete, and will fully convey the scope of the present invention to those skilled in the art. The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, the present invention will be described in detail with reference to the examples.

However, the following examples illustrate only the present invention, and therefore, the present invention is not limited to the following examples.

A iron metal and a aluminum metal are mixed by an appropriate mixing apparatus without separately treating a molybdenite concentrate in a powder type. The addition of the reducing agent, i.e., aluminum, is determined according to a content of components, i.e., molybdenum, iron, copper or the like to be reduced. The content of iron is determined by estimating a content of molybdenum in the final product, i.e., ferro molybdenum.

FIG. 1 is a schematic reduction apparatus furnished at a laboratory sufficient for implementing the present invention, wherein the heater may use any one of a direct method, an indirect method, preferably, an induction heating method.

In FIG. 1, a high frequency power supply unit of which power capacity is 50 KVA and frequency is 7 kHz was used and a graphite crucible heating element of which outer diameter is 13 cm and height is 16 cm was used.

When an apparatus according to the present invention is used for a large-capacity industrial facility, an molten iron metal is formed and then, aluminum and molybdenite are added, such that the process can be performed without a separate heating element.

As shown in FIG. 1, a mixed sample put in an alumina crucible is charged into a graphite crucible, a lid thereof is closed in order to block air, argon gas flows into the graphite crucible for a predetermined time to remove air, and then, the graphite crucible is heated at a targeted temperature using high frequency heating to progress the reaction.

Examples 1 to 6 according to the present invention were carried out as follows in the apparatus shown in FIG. 1.

The ore used in the present experiment is molybdenite concentrate having a particle size of 48 mesh or less and composed of 49.3% Mo, 34.8% S, 1.62% Cu, 2.17% Fe, and 8.11% gangue as the main components. The reducing agent used as the sample, i.e., aluminum, is a powder type and has 99.7% purity or more and 16# grain size or less and the additive, i.e., iron, is also a powder type and has 98% purity or more and 200# grain size or less.

Example 1

A mixture of a sample, i.e., 192 g molybdenite, 56 g iron powder, and 32 g aluminum powder was used as a reduction experiment sample by being rotated at 140 rpm for 30 minutes under the condition that the filling rate of a 1-l liter ceramic ball mill (diameter: 2 cm) is 50% and separating the balls.

In the reduction reaction, the alumina crucible having 8-cm diameter and 12-cm height was used as the reactor. The mixed sample put in the reactor was charged into the graphite crucible of the apparatus shown in FIG. 1 and the experiment was carried out. The argon flowed at a rate of 52/min for 20 minutes, heating started, the cruicible temperature reached 1690° C. after 70 minutes. Reduction reaction continued for 10 minutes at the temperature and the crucible was cooled at ambient temperature for 12 hours. The reaction product was well separated into slag and ferromolybdenum in the present experiment region. In this case, the characteristics of the ferromolybdenum produced were analyzed by X-ray diffraction as shown in FIG. 2.

Example 2

In the mixing of the sample, Example 2 was the same as Example 1 except that the addition of aluminum powder is 36 g.

Example 3

In the mixing of the sample, Example 3 was the same as Example 1 except that the addition of aluminum powder is 38 g.

Example 4

In the mixing of the sample, Example 4 was the same as Example 1 except that the addition of aluminum powder is 44 g.

Example 5

In the mixing of the sample, Example 5 was the same as Example 1 except that the addition of aluminum powder is 50 g.

Example 6

In the mixing of the sample, Example 6 was the same as Example 1 except that the addition of aluminum powder is 56 g.

(Analysis Results)

The following Table 2 shows the content of molybdenum Mo in the ferromolybdenum manufactured in Examples 1 to 6 and the concentration and removal rate of impurity, i.e., copper. It could be appreciated from Table 2 that the content of molybdenum in the ferromolybdenum manufactured in the Examples according to the present invention was 55% or higher, the removal rate of copper is a maximum of 96.3% at the aluminum addition of equivalence on the basis of $MoS_2$, ie the addition of aluminum is 36 g. The removal rate of copper is reduced as the addition of aluminum is increased.

TABLE 2

Concentration and Removal Rate of Molybdenum and Copper in Ferromolybdenum

| Example | Addition of Aluminum (g) | Mo Content (%) | Cu Concentration (%) | Cu Removal Rate (%) |
|---|---|---|---|---|
| 1 | 32 | 61.4 | 0.16 | 92.2 |
| 2 | 36 | 62.9 | 0.08 | 96.3 |
| 3 | 38 | 60.7 | 0.12 | 94.4 |
| 4 | 44 | 61.0 | 0.22 | 89.0 |
| 5 | 50 | 59.2 | 0.38 | 80.7 |
| 6 | 56 | 57.4 | 0.58 | 69.6 |

FIG. 2 shows an X-ray Diffraction Patterns of the ferro molybdenum manufactured in Examples 1 to 6. It could be appreciated from FIG. 2 that the metal sulfide phase did not exist when 38 g or more of aluminum is added (105% of chemical equivalence on the basis of Mo).

As could be appreciated from the Examples, the iron and the reducing agent, i.e., aluminum, was added to the molybdenite and was reacted in the induction heating furnace to maximally remove 95% or more of copper, thereby making it possible to manufacture the ferromolybdenum for making steel from the molybdenite with high copper content without carrying out a separate copper removing process.

As set forth above, the manufacturing method of ferro molybdenum according to the present invention carries out direct reduction without roasting molybdenite, thereby making it possible to simplify the process and reduce consumption of the reducing agent, i.e., aluminum. In particular, the present invention can manufacture the ferromolybdenum from the molybdenite with high copper content without carrying out a separate copper removing process. Meanwhile, since the generated slag is aluminum sulfide having a higher energy level than that of oxide, the present invention needs to supplement heat through direct and indirect heating due to the heat of reaction smaller than the metallothermic reduction method. However this process can further facilitate the recycling of aluminum in the slag. The present invention can further reduce energy than the existing process when considering the energy used in the processes, such as roasting, acid leaching, filtering, drying, etc., and control the reaction by controlling the output from the heating furnace, thereby making it possible to implement a production of homogeneous products and a continuous process.

The present invention is not limited to the embodiment described herein and it should be understood that the present invention may be modified and changed in various ways without departing from the spirit and the scope of the present invention. Therefore, it should be appreciated that the modifications and changes are included in the claims of the present invention.

What is claimed is:

1. A manufacturing method of ferromolybdenum, comprising:

a) preparing a mixture by mixing 15 to 20 wt % iron and 10 to 20 wt % metal aluminum in 60 to 70 wt % molybdenite with 0.5 to 10% copper content;

b) reacting the mixture in a heater at a temperature of 1100 to 2000° C. under an argon gas atmosphere; and c) naturally cooling the mixture at ambient temperature after the reaction ends to obtain reaction products.

2. The manufacturing method of ferromolybdenum of claim 1, wherein the reaction product has copper content less than 0.5%.

3. The manufacturing method of ferromolybdenum of claim 1, wherein the heater includes a direct heating furnace or an indirect heating furnace.

4. The manufacturing method of ferromolybdenum of claim 3, wherein the heater uses an induction heating method.

5. The manufacturing method of ferromolybdenum of claim 1, wherein step b) is carried out for 10 to 30 minutes.

* * * * *